United States Patent [19]

Sundberg et al.

[11] Patent Number: 4,545,413

[45] Date of Patent: Oct. 8, 1985

[54] DEVICE FOR USE IN WOOD CHIPPERS

[75] Inventors: Ake Sundberg, Iggesund; Gunnar Lindmark, Hudiksvall, both of Sweden

[73] Assignee: Aktiebolaget Iggesunds Bruk, Sweden

[21] Appl. No.: 485,072

[22] Filed: Apr. 14, 1983

Related U.S. Application Data

[63] Continuation of Ser. No. 215,946, Dec. 12, 1980, abandoned.

[30] Foreign Application Priority Data

Dec. 12, 1979 [SE] Sweden ..... 7910256

[51] Int. Cl.[4] ..... B27C 1/00

[52] U.S. Cl. ..... 144/176; 51/285; 144/114 A; 144/241; 144/359

[58] Field of Search ..... 51/285, 288; 241/92, 241/189 R, 278 R, 298; 144/162 R, 176, 241, 114 A, 359

[56] References Cited

U.S. PATENT DOCUMENTS 4,047,670 9/1977 Svensson ..... 144/176

4,298,044 11/1981 Hansel et al. ..... 144/241

*Primary Examiner*—W. D. Bray

*Attorney, Agent, or Firm*—William A. Drucker

[57] ABSTRACT

Device for use in connection with wood chippers of the type comprising a rotary disc (15) whereof one face is fitted with substantially radially positioned knives (1) which are attached thereto by means of knife holders (2) incorporating a log guiding surface. To give a twisted form to one face of the knife holders (2) the latter are fabricated by surface grinding of the log guiding face while the knife holder (2) is clamped in a grinding fixture (20) in a state of torsion which, after removal from the grinding fixture, gives the desired twisted shape to the log guiding face. After removal from the grinding fixture (20) the knife holder (2) is clamped in a torsion-free state in the chipping disc (15).

9 Claims, 5 Drawing Figures

DEVICE FOR USE IN WOOD CHIPPERS

This is a continuation of Ser. No. 215,946 filed Dec. 12, 1980 now abandoned.

The present invention is concerned with a device, for use in connection with wood chippers of the type comprising a rotary disc whereof one face is fitted with substantially radially positioned knives which are attached thereto by means of knife holders incorporating a log guiding surface, for giving a twisted form to the log guiding faces of the knife holders.

As disclosed in patent application No. 7706791-6, a torsion or twisting of the knives of chippers of the above-mentioned type can be brought about by fixing the knives and knife holders on mountings having a geometric form such that the knives, when mounted in the disc, are twisted to the desired angle in relation to the plane of rotation of the disc. For this purpose the knives and the fastenings are surface ground during fabrication and are twisted into the desired shape by means of the said mountings when fixed to the chipper disc.

The purpose of the present invention is likewise to produce a twisted face of the knife holders, but in another manner than in the above-cited patent. The features of the invention are as set forth in the claims hereafter.

The invention will be more particularly described in the form of an example of embodiment in conjunction with the drawings.

Figure 1:
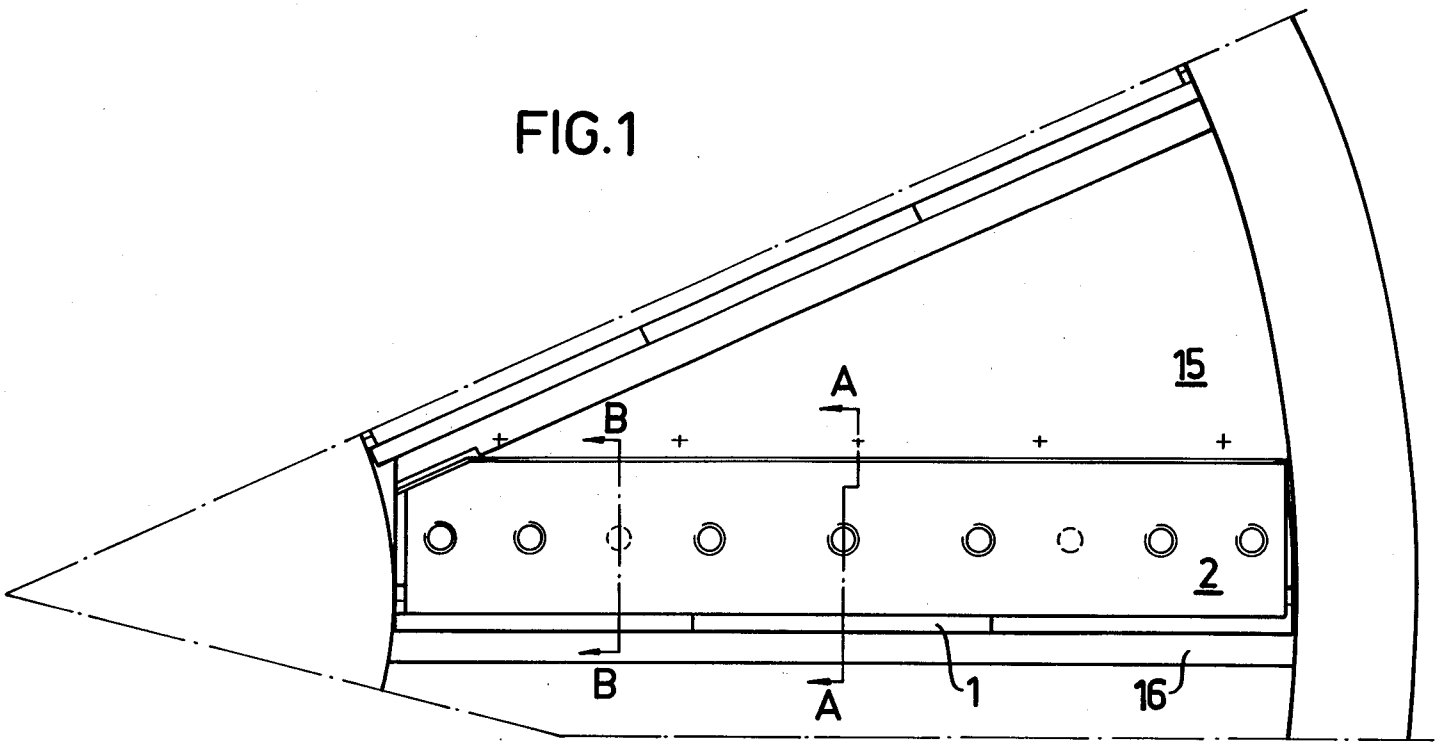
FIG. 1 shows a plan of part of a chipper disc with a knife clamped in place.
Figure 2:
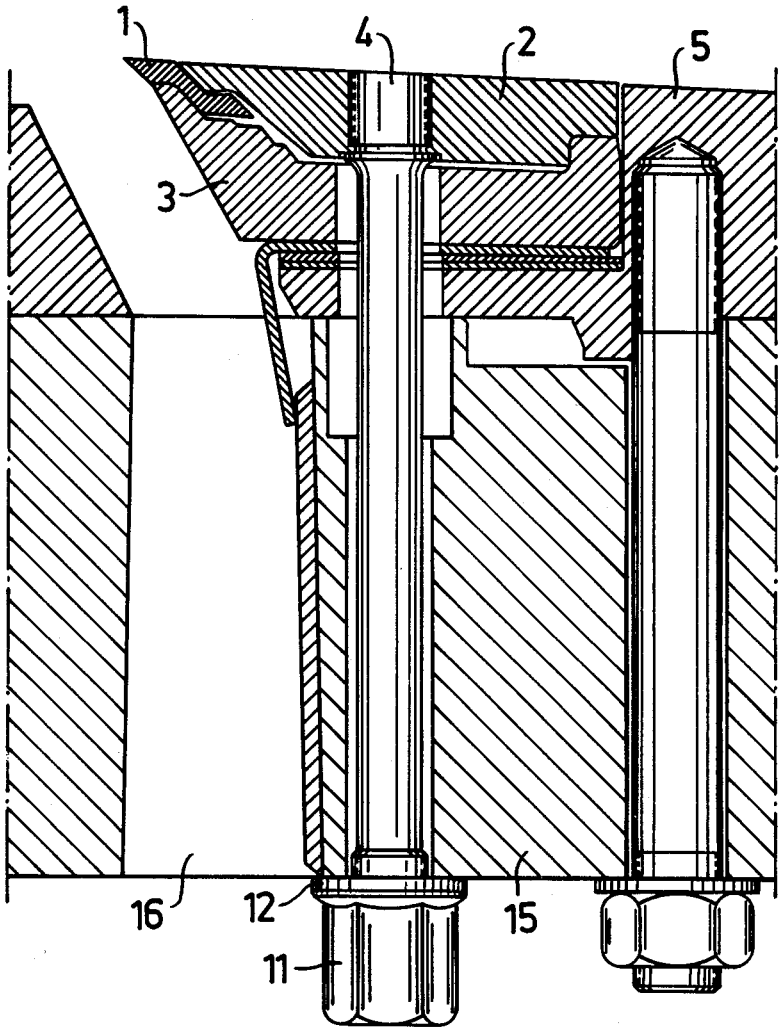
FIG. 2 shows a section on the line A—A in FIG. 1.
Figure 3:
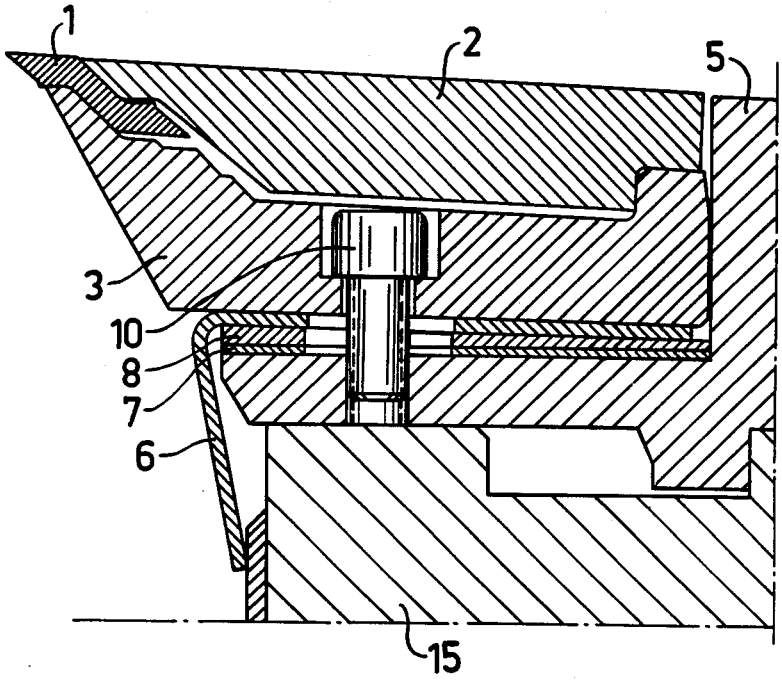
FIG. 3 shows a section on the line B—B in FIG. 1.

The chipper disc 15 appearing in FIG. 1 comprises knives 1, which in the illustrated embodiment consist of reversible blades of the type described in U.S. Pat. No. 4,047,670, which are fixed between a knife holder 2 and a chip guide 3, as shown in FIGS. 2 and 3. The knife holder 2 is clamped in the disc 15 by means of knife bolts 4 which are retained by a washer 12 and a nut 11. Wearing plates 5 are provided after the knife holders 2 in the direction of rotation of the disc. The chip guide 3, as shown in FIG. 3, is fixed to the wearing plate 5 by means of screws 10. Between the chip guide 3 and the wearing plate 5 there are provided spacing plates 7, 8. Under the chip guide 3 there is further provided a curved plate 6 which serves to protect the chipper disc and deflects the chips down into the opening 16 provided therefor in the disc.

Figure 4:
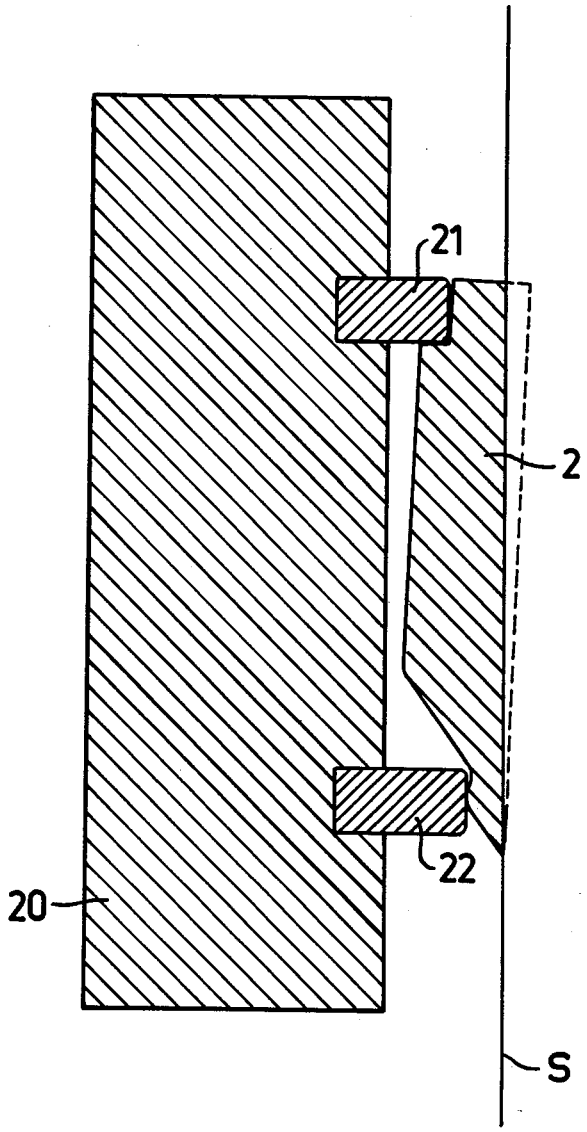
FIG. 4 shows a knife holder set up in a grinding fixture.

In order to ensure smooth feeding of the material against the chipper disc it is known in the art, to give the knife holders 2 a twisted form so as to guide the wood correctly whatever the distance from the centre of the disc. This is achieved, according to the present invention, as illustrated in FIG. 4, by setting up the knife holder 2 in a grinding fixture 20 in a state of torsion or twisting corresponding to the shape which the knife holder is to assume after clamping in the chipper disc 15. This may be achieved, for example, as shown in FIG. 4, by means of formers 21, 22 which serve to support the knife holder 2 in the grinding fixture and whose thickness is given a taper along the length of the knife holder corresponding to the desired twist of the knife holder. The knife holder 2 is then ground along one face, designated S in FIG. 4, whereafter the knife holder 2 is removed from the fixture and returns to a torsionless state. Thus when the knife holder 2 is removed from the fixture the ground top face thereof will assume a curved form determined by the shape of the formers 21, 22. When the knife holder is subsequently clamped in place in the chipper disc 15 in this torsionless state, as shown in FIGS. 1–3, one face of the knife holder 2 behind the knife 1 has been given a twisted form in a simple and accurate manner.

Figure 5:
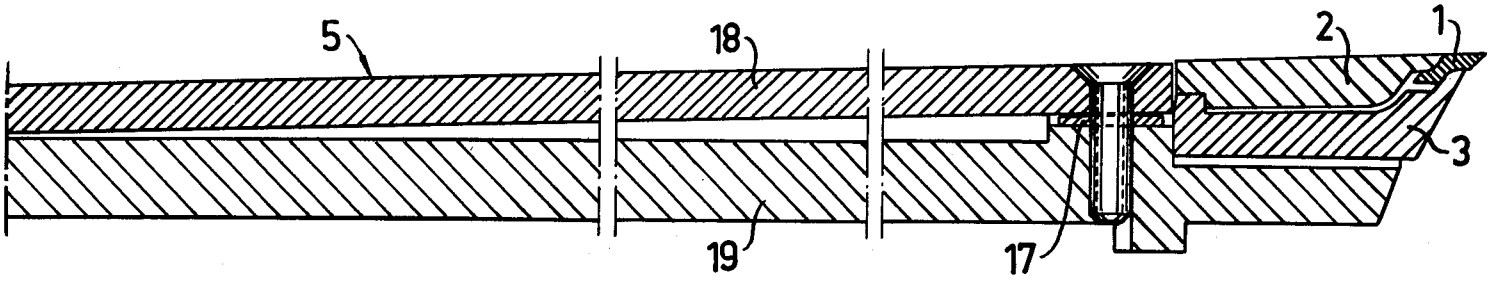
FIG. 5 shows a section similar to FIG. 2 through the top of the chipper disc, and a wearing plate positioned behind the knife holder.

To bring the wearing plate 5 adjoining the knife holder 2 into a state of twisting or torsion the wearing plate 5 is fixed, as illustrated in FIG. 5, in this twisted state by means of one or more formers 17 of such a shape that the twist of the wearing plate matches that of the knife holder 2. For this purpose, according to the invention, the wearing plate 5 is formed, as shown in FIG. 5, in two pieces, namely a top plate 18 of a wear-resistant material, e.g. hardened material, and a bottom plate 19, which may be made of a cheaper, ordinary material such as mild steel or the like. The formers 17 which effect the twisting of the top plate 18 are preferably positioned between the top plate 18 and the bottom plate 19.

Naturally the wearing plate 5, too, can be given a twisted form by grinding while clamped, in a manner similar to that described above with reference to the knife holders 2, if this should be desired for any reason.

It will be apparent from the foregoing description that the invention provides a simple and cheap method of giving a twisted form to matching parts of the chipper disc. Inasmuch as the system is based on faceground components, the system has high precision compared with designs in which the twisted form of the log guiding surface is brought about by grinding the said surface directly to a screw form.

We claim:

1. In a wood chipper of the type comprising a rotary disc whereof one disc face is fitted with substantially radially positioned knives which are attached to said disc face by means of a knife holder, in which the knife holder comprises a plate having a log guiding surface of twisted form for guiding the wood, the log guiding surface being formed by grinding of the log guiding surface of the knife holder while the latter is clamped in a grinding fixture in a state of torsion in comparison with its original neutral state, the degree of torsion being such that the desired twisted form is given to the log guiding surface of the knife holder when the latter, after removal from the grinding fixture, is clamped in the original neutral state in the rotary chipping disc.

2. In the device of claim 1 wherein said disc is fitted with wearing plates adjoining the knife holders, characterized in that the wearing plates have a face of twisted form.

3. In the device of claim 1 wherein the chipping disc is fitted with wearing plates adjoining the knife holders, characterized in that the wearing plates are fixed to the chipping disc in a state of torsion substantially matching the twist of the knife holders.

4. In the device of claim 3 further including means positioned under the wearing plates to provide torsion to said knife holders.

5. In the device of claim 4 characterized in that the wearing plates include a thinner top plate of wear-resisting material, and a thicker bottom plate of a less wear-resisting material.

6. In the device of claim 5 characterized in that the spacing elements which bring about the twisting of the wearing plate are positioned between said top plate and the bottom plate.

7. A method of fabricating a knife holder for use in connection with wood chippers of the type comprising a rotary chipping disc whereof one face is fitted with substantially radially positioned knives which are attached thereto by means of knife holders incorporating a log guiding surface for giving a twisted form to the log guiding faces of the knife holders, comprising the steps of:

(a) clamping the knife holder in a guiding fixture with the holder being in a state of torsion, (b) surface grinding the log guiding surface of the knife holder while clamped in the fixture to provide the desired twisted form to the log guiding surface of the knife holder when removed from the fixture, (c) removing the knife holder from the grinding fixture, and (d) clamping the ground knife holder in a torsion-free state in a chipping disc.

8. Method of claim 7 further including:

(e) clamping a knife holder wearing plate in a grinding fixture in a state of torsion, and (f) surface grinding the wearing plate while in said fixture.

9. Method of claim 8 wherein the wearing plates are fixed to said grinding fixture in a state of torsion matching the torsion of said knife holders.

* * * * *